US005427884A

United States Patent [19]

Ohtani et al.

[11] Patent Number: 5,427,884

[45] Date of Patent: Jun. 27, 1995

[54] DEVELOPER COMPRISING TONER CONTAINING SPECIFIED CHARGE CONTROLLING AGENT AND CARRIER COATED WITH POLYOLEFINIC RESIN

[75] Inventors: Junji Ohtani, Kobe; Junji Machida, Toyonaka; Yoshihisa Terasaka, Settsu, all of Japan

[73] Assignee: Minolta Camera Kabushiki Kaisha, Osaka, Japan

[21] Appl. No.: 110,650

[22] Filed: Jul. 30, 1993

Related U.S. Application Data

[63] Continuation of Ser. No. 727,535, Jul. 9, 1991, abandoned.

[30] Foreign Application Priority Data

Jul. 12, 1990 [JP] Japan ..... 2-186694

[51] Int. Cl.[6] ..... G03G 9/00

[52] U.S. Cl. ..... 430/110; 430/111

[58] Field of Search ..... 430/110, 111

[56] References Cited

U.S. PATENT DOCUMENTS

| | | | |
|---|---|---|---|
| 4,304,830 | 12/1981 | Bolte et al. | 430/137 |
| 4,326,019 | 4/1982 | Lu et al. | 523/211 |
| 4,564,647 | 1/1986 | Hayashi et al. | 430/108 |
| 4,741,984 | 5/1988 | Imai et al. | 430/110 |
| 4,980,258 | 12/1990 | Aoki et al. | 430/110 |
| 5,093,201 | 3/1992 | Ohtani et al. | 430/108 |
| 5,098,811 | 3/1992 | Anno et al. | 430/110 |

FOREIGN PATENT DOCUMENTS

| | | |
|---|---|---|
| 52-154639 | 12/1977 | Japan . |
| 54-35735 | 3/1979 | Japan . |

*Primary Examiner*—Mark A. Chapman

*Attorney, Agent, or Firm*—Burns, Doane, Swecker & Mathis

[57] ABSTRACT

This invention relates to a two-component developer composed of at least a toner and a carrier, in which the toner contains a quaternary ammonium salt and/or a nitrogen-containing polymer and the carrier is coated with a polyolefinic resin layer.

18 Claims, 4 Drawing Sheets

DEVELOPER COMPRISING TONER CONTAINING SPECIFIED CHARGE CONTROLLING AGENT AND CARRIER COATED WITH POLYOLEFINIC RESIN

This application is a continuation of application Ser. No. 07/727,535, filed Jul. 9, 1991, now abandoned.

BACKGROUND OF THE INVENTION

This invention relates to a two-component developer containing a toner and a carrier. More particularly, the toner comprises quaternary ammonium salt and/or a nitrogen-containing polymer as a positive charge-controlling agent and the carrier is coated with polyolefinic resin.

A two-component developing method, in which insulating nonmagnetic toner particles are mixed with carrier particles to be frictionally charged and these particles are carried and brought into contact with electrostatic latent images to develop electrostatic latent images, has been known as an electrostatic latent image-developing method.

The carrier particles used in such the two-component developing method have been usually coated with suitable materials on account of reasons such as the prevention of toners from forming films on surfaces of carrier particles, the formation of a surface having uniform properties, the prevention of surface oxidation, the prevention of deterioration resistance to humidity, the prolongation of useful life time of developers, the protection of a photosensitive member from damages or abrasion by carriers, the control of chargeable polarity and the control of a charging quantity.

Polyolefinic resins have been known as such a coating material.

As the chargeability of toner is usually much influenced by the combination of toner with carrier, the coating material should be selected in its individual combination.

Japanese Patent Laid-Open No. Hei 2-22673 discloses a developer for developing electrostatic latent images containing a carrier coated with a fluorine resin. The carrier of the present invention is coated with a polyolefinic resin different from the fluorine resin. There is neither disclosed nor suggested anywhere that the toner used in the combination with the carrier coated with fluorine resin may be used in the combination with the carrier coated with polyolefinic resin as disclosed in the present invention. Accordingly, a carrier coated with a polyolefinic resin should be studied individually in relationship to a toner used therewith in response to the properties of the carrier.

A toner, one of elements of the two-component developer, usually contains a charge controlling agent on account of adjustment of charging level and security of charging stability. A positive-charge controlling agent is added to a positively chargeable toner.

However, as a polyolefinic resin itself tends to be charged negatively, some positive-charge controlling agents work to charge a toner positively to excess. When the usage of such the positive-charge controlling agents is decreased to lower the charging level, the uniform dispersion of the positive-charge controlling agent into toner becomes difficult and so the charging stability can not be secured and toner particles come to scatter.

SUMMARY OF THE INVENTION

The object of the present invention is to provide a developer comprising a carrier coated with a polyolefin resin and a toner which is positively tribo-charged with the carrier to an adequate level and stable in charging level.

Another object of the present invention is to provide a developer excellent in electrification-build-up properties and without toner scattering.

The present invention relates to a two-component developer composed of at least a toner and a carrier, in which the toner contains a quaternary ammonium salt and/or a nitrogen-containing polymer and the carrier is coated with a polyolefinic resin layer having protuberances.

DETAILED DESCRIPTION OF THE INVENTION

Figure 1:
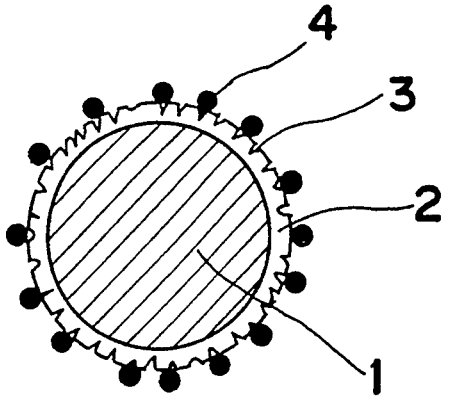
FIG. 1 shows a schematic sectional view of a resin-coated carrier having pores.

The present invention provides a two-component developer excellent in charging level and charging stability of toner, and prevention of toner scattering, in which the toner is used in the combination with a carrier coated with a polyolefinic resin.

The present invention has accomplished the above objects by introducing a quaternary ammonium salt and/or a nitrogen-containing polymer into a toner and, preferably by specifying a carrier coated with a polyolefinic resin.

A developer provided according to the present invention is a two-component developer composed of at least a toner and a carrier, in which the toner contains a quaternary ammonium salt and/or a nitrogen-containing polymer as a charge-controlling agent and the carrier is coated with a polyolefinic resin layer having protuberances.

The incorporation of a quaternary ammonium salt and/or a nitrogen containing polymer as a positive charge controlling agent secures adequate charging level, charging stability and prevention of toner scattering when the toner is used in the combination with a specified carrier coated with a polyolefinic resin described hereinafter.

The quaternary ammonium salts and/or the nitrogen containing polymers are exemplified by the ones represented by the general formulae [I]–[VI].

The general formula [I] (quaternary ammonium salt)

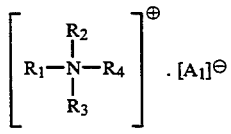

[I]

in which $R_1$, $R_2$, $R_3$ and $R_4$ may be same or different respectively and represent a hydrogen atom, a $C_1$–$C_{30}$ alkyl group, an aralkyl group such as a benzyl group and the like, an aryl group such as a phenyl group respectively.

$A_1$ represents a sulfate ion, a nitrate ion, a borate ion, a basic ion, a chlorine ion, an iodine ion, a molybdate ion, a tungstate ion, an ion of heteropolyacid containing a molybdenum atom or a tungsten atom.

The quaternary ammonium salts represented by the general formula [I] are shown below but those are shown with no significance in restricting the embodiments of the invention.

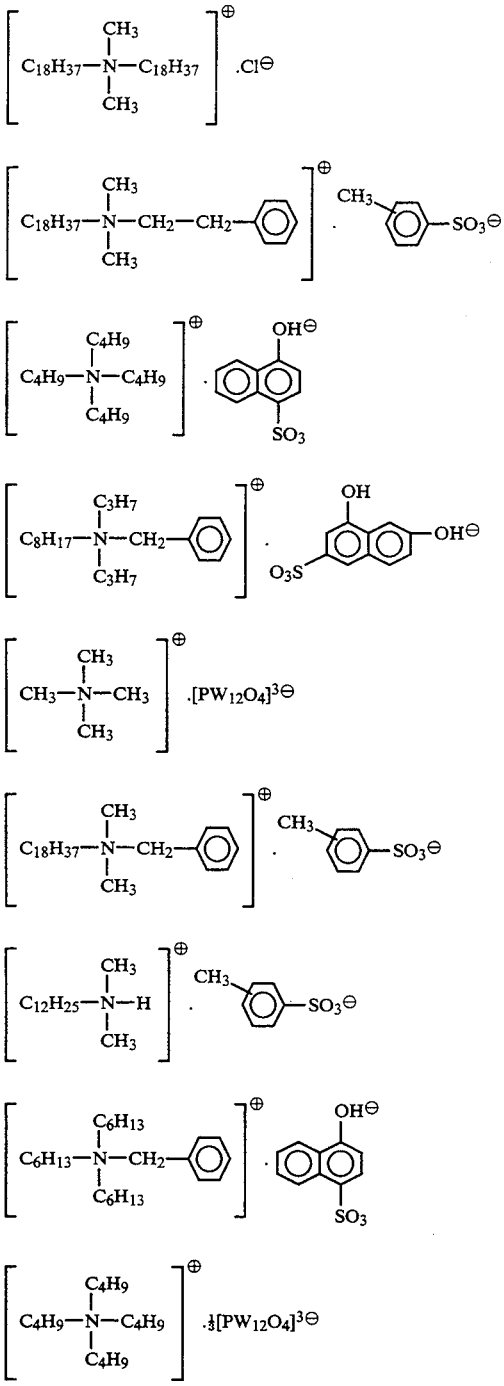

-continued

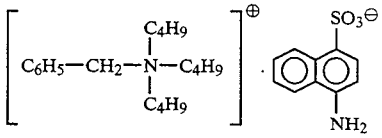

The general formulae [II]–[IV] (alkyl pyridinium compound)

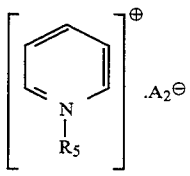

[II]

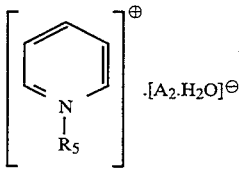

[III]

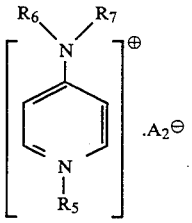

[IV]

in which $R_5$ is a $C_1$–$C_{20}$ alkyl group; $R_6$ and $R_7$ are a $C_1$–$C_{20}$ alkyl group respectively; $R_6$ and $R_7$ may form a ring in combination; $A_2$ shows as anion such as halogen atoms (chlorine, bromine, iodine and the like), sulfate, sulfite, nitrate, borate and the like.

Examples of alkylpyridinium compound represented by the general formulae [II]–[IV] are cetylpyridinium chloride heptadecyl-pyridinium bromide, octyldecyl-pyridinium chloride, cetylpyridinium.p-toluene sulfonate, stearylpyridinium.p-toluene sulfonate, cetyl-pyridinium.dodecylbenzene sulfonate and the like, which are shown with no significance in restricting the compounds of the formulae [II]–[IV]. The general formula [V] (quaternary ammonium salt)

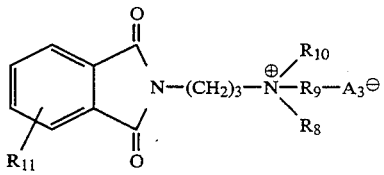

[V]

in which $R_8$, $R_9$ and $R_{10}$ are an $C_1$–$C_{25}$ alkyl group respectively; $R_{11}$ is a hydrogen atom, a nitro group, a halogen atom, an amino group or an alkyl group; $A_3$ shows an anion such as a halogen atom (chlorine, bromine, iodine or fluorine), sulfonate p-toluenesulfonyl, sulfonate, tetrafluoroborate and the like.

Examples of quaternary ammonium salts represented by the general formula [V] are (3-phthalimidopropyl)-trimethylammonium methylsulfate, (3-phthalimidopropyl)dimethylcetylammonium bromide, (3-phthalimidopropyl)trimethylammonium tetrafluoroborate, (3-phthalimidopropyl)dimethylcetylammonium tetrafluoroborate and the like, which are shown with no significance in restricting the compounds of the formula [V].

The general formula [VI] (quaternary ammonium salt);

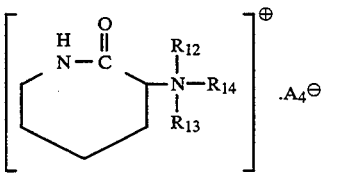

[VI]

in which $R_{12}$, $R_{13}$ and $R_{14}$ may be same or different and show a hydrogen atom, an alkyl group which may have a substituent, an aryl group which may have a substituent, an aralkyl group which may have a substituent or a cycloalkyl group which may have a substituent; $A_4$ shows an anion such as halogen atom (fluorine, chlorine and the like), sulfate and the like.

Examples of quaternary ammonium salts represented by the general formula [VI] are

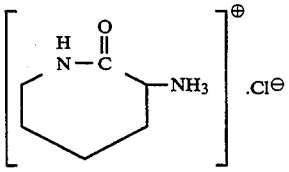

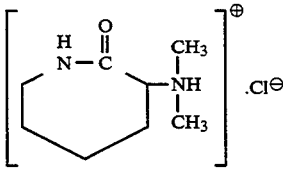

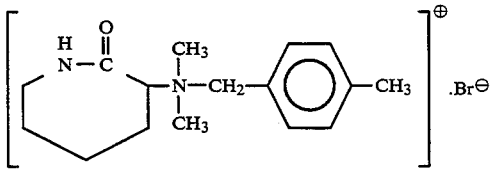

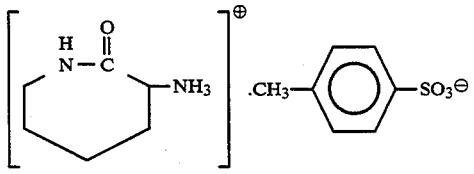

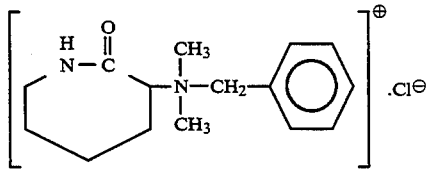

which are shown with no significance in restricting the compounds of the formula [VI].

The nitrogen-containing polymers used in the present invention are preferably exemplified by the ones represented by the general formulae [VII]–[X].

The general formula [VII] (an aminostyrene or a derivative thereof);

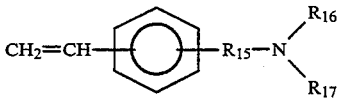

[VII]

in which $R_{15}$ is a $C_0$–$C_{12}$ alkylene group; $R_{16}$ and $R_{17}$ are a hydrogen atom or a $C_1$–$C_{20}$ alkyl group respectively.

The general formula [VIII] (a vinyl imidazole or a derivative thereof)

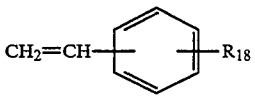

[VIII]

in which $R_{18}$ shows a hydrogen atom or a lower alkyl group.

The general formula [IX] (vinylimidazole or a derivative thereof)

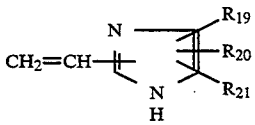

[IX]

in which $R_{19}$, $R_{20}$ and $R_{21}$ are respectively a hydrogen atom or a $C_1$–$C_{20}$ alkyl group.

The general formulae [X], [XI] and [XII]

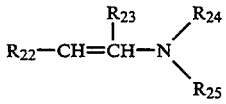

[X]

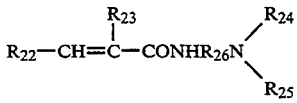

[XII]

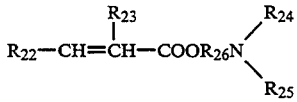

[XI]

in which $R_{22}$ and $R_{23}$ are respectively a hydrogen atom, or a $C_1$–$C_{10}$ alkyl group; $R_{24}$ and $R_{25}$ are respectively a hydrogen atom, a $C_1$–$C_{20}$ alkyl group or an aryl group; $R_{26}$ is a $C_1$–$C_{20}$ alkylene group.

The positive charge controlling agent may be used singly or in combination therewith The usage thereof is 0.1–20 parts by weight, preferably 1–10 parts by weight, more preferably 2–7 parts by weight on the basis of 100 parts by weight of a binder resin described hereinafter. If the usage is less than 0.1 part by weight, the charge controlling effects can not be obtained. If the usage is more than 20 parts by weight, environmental resistance, in particular, chargeability under high humid conditions may become unstable.

A toner used in the present invention is positively chargeable and composed of at least a thermosetting resin, a colorant, the positive-charge controlling agent as described above, and an other additive such as an off-set prevention agent, if necessary. The toner may be prepared by a known method such as a suspension polymerization method, a grinding method, an encapsulating method, a spray-drying method, a mechanochemical method and the like so that they may have a mean particle size of 3–20 μm.

The thermosetting resins are exemplified by homopolymers and derivatives thereof such as polystyrene, poly-p-chlorostyrene, polyvinyltoluene and the like, styrene copolymers such as styrene-p-chlorostyrene copolymer, styrene-propylene copolymer, styrene-vinyltoluene copolymer, styrene-vinylnaphthalene copolymer styrene-methyl acrylate copolymer, styrene-ethyl acrylate copolymer, styrene-butyl acrylate copolymer, styrene-octyl acrylate copolymer, styrene-methyl methacrylate copolymer, styrene-ethylmethacrylate copolymer, styrene-butyl methacrylate copolymer, styrene-methyl dichloromethacrylate copolymer, styrene-acrylonitrile copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-acrylonitrile-indene copolymer, styrene-maleic acid copolymer, styrene-maleate copolymer and the like, poly(methyl methacrylate), poly(butyl methacrylate), poly(vinyl chloride), poly(vinyl acetate), polyethylene, polypropylene, polyester, polyurethane, polyamide, epoxy resin, poly(vinyl butyral), poly(acrylic acid), rosin, modified resin, terpene resin, phenol resin, aliphatic or alicyclic hydrocarbon resin, aromatic petroleum resin, chlorinated paraffin, paraffin wax, a mixture thereof.

With respect to the colorants incorporated in the toner, for a black pigment, is available carbon black, acetylene black, lamp black and the like;

for a red pigment, is available red iron oxide, cadmium red, red lead oxide, cadmium mercury sulfide, permanent red 4R, lithol red, pyrazolone red, watchung red, calcium salt, lake red D, brilliant carmine 6B, cosine lake, rhodamine lake B, alizarin lake, brilliant carmine 3B and the like;

for a green pigment, is available chrome green, chrome oxide green, pigment green B, malachite green lake, fanal yellow green G and the like;

for a blue pigment is available prussian blue cobalt blue, alkali blue lake, victoria blue lake, phthalocyanine blue, metal-free phthalocyanine blue, phthalocyanine blue partial chlorine compound, fast sky blue, indanthrene blue BC and the like;

for a magenta pigment, is available manganese violet, fast violet B, methyl violet lake and the like;

for a sepia pigment, is available permanent brown, parabrown;

for a white pigment, is available zinc white, titanium oxide, antimony white, zinc sulfide and the like.

for a yellow pigment, is available chrome yellow, zinc yellow, cadmium yellow, yellow oxide, mineral fast yellow, nickel titanium yellow, nables yellow, naphthol yellow S, hansa yellow G, hansa yellow 10G, benzidine yellow G, benzidine yellow GR, quinoline yellow lake, permanent yellow, NCG, tartrazine lake and the like;

for an orange pigment, is available chrome orange, molybdenum orange, permanent orange GTR, pyrazolone orange, vulcan orange, indanthrene brilliant orange RK, benzidine orange G, indanthrene brilliant orange GK and the like;

Such colorants can be used singly or in combination with other colorants at the content of 1–20 percents by weight, preferably 3–7 percents by weight on the basis of the total toner weight.

Off-set prevention agents may be incorporated into a toner of the present invention to improve fixing properties. Such off-set prevention agents are exemplified by various kinds of wax, preferably polyolefin wax such as low molecular weight polypropylene, polyethylene, polypropylene of oxidized type and polyethylene of oxidized type.

A toner of the present invention may be added with fluidization agents. Such a fluidization agents are exemplified by silica, aluminum oxide, titanium dioxide, a mixture of silica with aluminum oxide, a mixture of silica with titanium dioxide and the like.

A carrier used in the combination with the above toner is explained hereinafter.

A carrier of the present invention is composed of a carrier core coated with polyolefinic resin. The polyolefinic resin means a polymer of olefinic monomer such as ethylene, propylene, butene, butadiene or the like.

With respect to the carrier core material, which is one of elements of the carrier of the present invention, the one having a mean particle size of at least 20 μm in view of the prevention of adherence (scattering) of carrier particles to a supporter of an electrostatic latent image and at most 100 μm in view of the prevention of deterioration of image quality, for example the prevention of generation of carrier lines, is used. Concretely speaking, materials known as electrophotographic two-component carriers, for example metals such as ferrite, magnetite, iron, nickel, cobalt and the like, alloys or mixtures of the above metals with metals such as zinc, antimony, aluminum, lead, tin, bismus, beryllium, manganese, selenium, tungsten, zirconium, vanadium and the like, metal oxides such as iron oxides, titanium oxides, magnesium oxides and the like, nitrides, such as chrome nitrides, vanadium nitrides and the like, and carbides such as silicon carbides, tungsten carbides and the like, ferromagnetic ferrites, and mixtures thereof, can be used.

The core material of carrier is coated by polyolefinic resin so that 70% or more, preferably 90% or more, still more preferably 95% or more of surface area of the cores may be coated. If the coating ratio is lower than 70%, characteristics of the carrier core material itself (unstable environmental resistance, reduction of electric resistance and unstable charging properties) strongly appear, so that the advantages of the coating with resins can not be obtained.

A content of carrier core material based on the carrier (hereinafter referred to as filling ratic by weight percent) is set at about 90 wt % or more, preferably 95 wt % or more. The filling ratio may be understood to show indirectly a layer-thickness of carrier coated with resin. If the filling ratio is lower than 90 wt %, the coating layer becomes so thick that, for example, the coating layer is separated, the charge amount being increased, the durability and the charging stability being not satisfactory. In view of the image quality, the fine line reproducibility is inferior and the image concentration is reduced, when the carries are used as a developer.

The layer-thickness of polyethylenic resins may be indirectly expressed also by a true specific gravity. The true specific gravity of the carriers according to the present invention is greatly changed by a kind of carrier core material but it is set at about 3.5 to 7.5, preferably about 4.0 to 6.0, still more preferably about 4.0 to 5.5, so far as the carrier core material is used. If the specific gravity of the carriers is outside of the range, problems similar to those incidental to the carriers, which are not coated at the suitable content, occur.

An electric resistance of the polyolefinic resin-coated carriers with irregularities according to the present invention is set at about $1\times10^6$ to $1\times10^{14}$ ohm.cm, preferably about $10^8$ to $10^{13}$ ohm.cm, still more preferably about $10^9$ to $10^{12}$ ohm.cm. If the electric resistance is lower than $1\times10^6$ ohm.cm, the carriers are developed to deteriorate the image quality. In addition, if the electric resistance exceeds $1\times10^{14}$ ohm.cm, toners are electrically charged excessively so that the appropriate image. concentration can not be obtained. It can be also thought that the electric resistance indirectly expresses the coating ratio with polyolefinic resins and the filling ratio of carrier core materials.

Additives, such as fine particles having a charge controlling function or electrically conductive fine particles, may be added to a polyolefinic layer in the present invention.

Concretely speaking, the fine particles having a charge controlling function include metal oxides, such as $CrO_2$, $Fe_2O_3$, $Fe_3O_4$, $IrO_2$, $MnO_2$, $MoO_2$, $NbO_2$, $PtO_2$, $TiO_2$, $Ti_2O_3$, $Ti_3O_5$, $WO_2$, $V_2O_3$, $Al_2O_3$, MgO, $SiO_2$, $ZrO_2$ and BeO, dyestuffs such as Nigrosine Base and Spilon Black TRH and the like.

The electrically conductive fine particles include carbon blacks, such as carbon black, acetylene black and the like, carbides, such as SiC, TiC, MoC, ZrC and the like, nitrides, such as BN, NbN, TiN, ZrN and the like, magnetic powders, such as ferrite, magnetite and the like.

The addition of metal oxides, metal fluorides and metal nitrides is effective for the further enhancement of the chargeability. Such the effect seems to be brought about by a synergism of the charging effects of the respective ingredients and the toners resulting from a contact of a complicated boundary surface formed with such the compounds, polyolefin and the core material with the toners.

The addition of carbon black is effective for the enhancement of the development and the obtainment of an image having a high image concentration and a clear contrast. It seems that the addition of the electrically conductive fine particles, such as carbon black, leads to a moderate reduction of electric resistance of the carriers and the well-balanced leak and accumulation of electric charge.

One of characteristics of the conventional binder type carriers consists in the superior reproducibilities of halftone and tone gradient. With respect to the coated carriers according to the present invention, the carriers superior in reproducibility of tone gradient are obtained by adding magnetic powders to the polyolefinic resin-coating layer. It seems that a surface composition similar to that of the binder type carriers is obtained by adding the magnetic powders to the polyolefin-coating layer, whereby the chargeability and specific gravity approach to those of the binder type carriers.

The addition of borides and metal carbides is effective for electrification-build up properties.

The size of the above additives, the additional quantity of the additives and the like are not specially limited so far as various kinds of characteristic of the carriers according to the present invention, such as, coating ratio, electric resistance and the like described in the specification of the present invention, are satisfied. But, in relation to a method of producing the carriers according to the present invention, which will be mentioned later, the size of the fine particles may be allowed to such a degree that, for example, they are uniformly dispersed in resin solution or dehydrated hexane to be turned into a slurry without cohering. Concretely speaking, a mean particle diameter may be 2 to 0.01 μm, preferably 1 to 0.01 μm.

Also the quantity of the above additives; can not be generally limited. But, 0.1 to 60 wt %, preferably 1.0 to 40 wt %, based on polyolefinic resins is suitable.

In particular, when the filling ratio is, adjusted to 90–97 wt % according to the present invention, it is preferable that the additives, such as the fine particles having a charge controlling function, the electrically conductive particles or the like are added into the polyolefinic resin layer.

In the case where the filling ratio of carriers is small, i.e. about 90 wt % or less, namely when a coating layer is comparatively thick, a problem occurs. The reproducibility is reduced when the continuous copying of fine lines is conducted by the use of such the carriers. Such the problem, however, can be solved by adding the above additives.

Carrier core materials may be coated with polyolefinic resin by a known method. Polyolefinic resins such as polypropylene and the like are heated and molten in an adequate solvent and the molten resin solution is sprayed on the carrier core materials to coat the surface thereof with the polyolefinic resin (as shown, for example, in Japanese Patent Laid-Open No. Sho 52-154639). In another method, coating powder is adhered to surface of carrier and the powder is heated to melting point or more to fix as shown, for example, in Japanese Patent Laid-Open No. Sho 54-35735. Polyolefinic resin may be also coated by a polymerization method. Such a surface coating method by polymerization can be carried out by polymerizing olefinic monomer such as ethylene on a carrier core material which is treated in advance with a highly active catalyst ingredient containing titanium and/or zirconium and soluble to hydrocarbon solvents in the presence of organic aluminum compounds. Fine particles having a charge controlling function and electrically conductive fine particles may be added at the formation of the polyethylenic resin-coating layer. For example, the method disclosed in U.S. Pat. No. 4,564,647 and in Japanese Patent Laid-Open No. Sho 60-106808 and Laid-Open No. Sho 60-106809 are suitable. The publication is herein cited as a part of the specification of the present invention. According to the coating method by polymerization, a coating layer excellent in durability is formed because of layer strength and adhesivity to core material.

In a preferable embodiment, the surface of carrier coated with polyolefinic resin has pores.

As described above, when the toner containing the quaternary ammonium salt and/or the nitrogen-containing polymer is used in the combination with the carrier coated with polyolefinic resin, the adequate adjustment and stabilization of charging level can be achieved.

However there is a problem that electrification build-up speed is slow. Therefore, as the copying speed increases, the irregularity of charging level becomes remarkable and the toner particles come to be liable to scatter.

In order to solve the above problem, the present invention also provides a carrier coated with polyolefinic resin having pores on the surface of the carrier, in which the pores have (1) pore size distributed within the range of 0.01–3 μm, (2) mean pore size within the range of 0.1–0.5 μm, and (3) total pore volume of 0.1–2 ml/ml referred to as unit volume of resin of coating layer.

Figure 3:
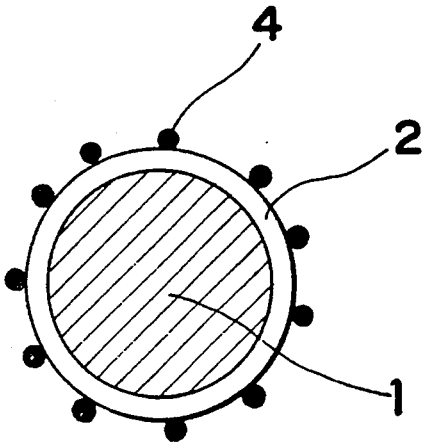
FIG. 3 shows a schematic sectional view of a resin-coated carrier having not pores.

A schematic sectional view of the resin-coated carrier having the pores is shown in FIG. 1 for easy understanding. A schematic sectional view of a resin-coated carrier having not pores is also shown in FIG. 3.

In FIG. 1, the number (1) shows a carrier core material, the number (2) shows a resin-coating layer and the number (3) shows pores formed on the resin-coating layer. The carrier shown in FIG. 3 has not the pores (3). The pores on the surface of carriers function to contact toner particles (4) with the carrier particles sufficiently and effect speedy electrification-build up and uniform charging of toner. Toner scattering caused by poor charging can be prevented. It also effects the prevention of toner scattering that the pores on the carrier surface are excellent in trapping toner particles.

Further, the pores effect the prevention of toner particles from aggregation and the breaking of aggregated toner particles because the toner particles contact with the carrier particles frequently. Therefore, the problem of toner aggregation, which is brought about particularly in the case of small toner particles, can be solved.

The pores on the surface of the resin-coated layer can be specified concretely by pore size distribution, mean pore size and total pore volume.

The desirable pore size distribution is within the range of 0.001–3 μm, preferably 0.001–2 μm, more preferably 0.005–2 μm. If the pore size is smaller than 0.001 μm, satisfactory effects can not be expected in the viewpoint of toner grinding properties. If the pore size is larger than 3 μm, the toner-trapping properties become much strong, resulting in the deterioration of toner fluidity and developing properties.

The desirable mean pore size is within the range of 0.1–0.5 μm.

Thereby, the breaking properties of toner aggregation and the charging properties of toner can be improved.

The total pore volume can be expressed in two ways. The one has the unit (mg/g) referred to as one gram of carrier and the other has the unit (ml/ml) referred to as one milliliter of resin of coating layer.

The total pore volume (ml/g) referred to as one gram of carrier can be determined by mercury porosimetry. The desirable total pore volume (ml/g) is within the range of 0.001–0.1 ml/g, Preferably 0.01–0.05 ml/g. If the volume is smaller than 0.001 (ml/g), the sufficient number of pores do not exist on the carrier surface, so that the effects caused by the pores may not be obtained. If the volume is larger than 0.1 ml/g, there exist so many pores that the coating layer becomes fragile.

The total pore volume (ml/ml) can be calculated from a specific gravity of coating layer and a filling ratio of carrier core material on the basis of the total pore volume (ml/g). The desirable total volume (ml/ml) is within 0.1–2 ml/ml, preferably 0.5–1.5 ml/ml. If the volume is smaller than 0.1 ml/ml, the sufficient number of pores do not exist on the carrier surface, so that the effects caused by the pores may not be obtained. If the volume is larger than 0.1 ml/g, there exist so many pores that the coating layer becomes fragile.

Figure 2:
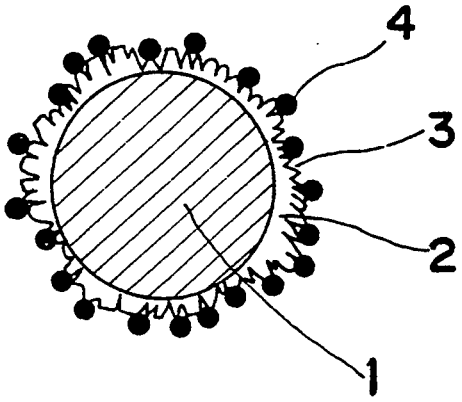
FIG. 2 shows a schematic sectional view of a carrier having pores on an irregular resin-coating layer.

In further preferable embodiment, the carrier used in the present invention is provided with irregularities. FIG. 2 shows such a carrier, in which pores (3) exist on the surface of irregular resin-coating layer (2). The irregular resin-coating layer improves electrification-build-up properties of toner, prevention of toner scattering, breaking properties of toner aggregation and the like.

The surface irregularity is explained in detail hereinafter.

The irregularity of the surface may be represented by the shape factor S represented by the following formula [A]:

$$S=\{(\text{outside circumference})^2/\text{area}\}\times\{1/(4\pi)\}\times 100 \quad [A]$$

wherein the "outside circumference" is a mean value of outside circumferences of projected images of the carrier particles and the "area" is a mean value of projected areas of the carrier particles. Its preferable value S is 130 to 200. The value S represents a degree of irregularity of the surface of particles. The greater the degree of irregularity of the surface is, the further than 100 it shows.

The shape factor S can be measured, for example, by an image analyzer (Louzex 5,000 manufactured by Japan Regulator K.K.) but it has been observed that in general the measurement of the shape factor is independent upon a kind of image analyzers, so that the image analyzer used for the measurement of the shape factor S is not limited by the above described kind of image analyzer.

A coating layer of polyolefinic resin having the pores may be formed as follows; for example, fine particles which are soluble in an adequate solvent are dispersed in a resin solution in advance, the solution is applied to carrier particles to form a resin-coating layer, the carrier particles are dipped in a solvent which can dissolve the fine particles, and then the fine particles are eluted to form pores on the surface of carrier. In this preparation method, the pore size is dependent on particle size and dispersion degree of the fine particles.

With respect to fine particles, alkali metal halides, alkali earth metal halides, alkali metal hydroxides, alkali earth metal hydroxides, transition metal complexes and the like can be used. With respect to the solvents which can solve the fine particles, it is required not to dissolve the coating-layer.

In a particular embodiment, in the case where the resin-coating layer contains ferrite particles, the ferrite particles can be eluted by dipping in an acidic aqueous solution such as hydrochloric acid etc. Thereby, the core are formed on the surface of carrier.

When the fine particles having a charge controlling function or the electrically conductive particles are added to the resin-coating layer, these additives are added to a resin solution for preparation of coating-layer at the same time. Ferrite and the like which can be used both for forming pores and for providing electrical conductivity are useful from productive and characteristic viewpoints.

By the production method as above mentioned, the pores are formed sufficiently. However, those production methods may not be suitable for forming the surface irregularities as above mentioned, except for the surface-coating method by polymerization.

In the present invention, a carrier and a toner obtained as above mentioned are mixed to prepare a developer, which can charge the toner stably to an adequate positive level and is excellent in electrification build-up properties of toner, prevention of toner scattering, breaking properties of toner aggregation.

A toner is mixed with a carrier so as to occupy 2–20 percents by weight, preferably 3–15 percents by weight, more preferably 4–12 percents by weight. If the mixing ratio is less than 2 percents by weight, the toner is charged excessively and the density of copied images become insufficient. If the ratio is more than 20 percents by weight, the toner particles scatter and pollute the inside of a copying machine, and toner fogs are formed on copied images.

PRODUCTION EXAMPLE 1 of Carrier

(1) Preparation of Titanium-containing Catalyst Ingredient

N-heptane, which had been dehydrated at room temperature, of 200 ml and magnesium stearate, which had been dehydrated at 120 ° C. under vacuum (2 mmHg), of 15 g (25 mmol) were put in a flask having the capacity of 500 ml replaced with argon to be turned into a slurry. Titanium tetrachloride of 0.44 g (2.3 mmol) was added drop by drop to the resulting slurry with stirring and then the resulting mixture was heated and subjected to a reaction for one hour with refluxing. A viscous and transparent solution of a titanium-containing catalyst ingredient was obtained.

(2) Evaluation of the Activity of the Titanium-Containing Catalyst Ingredient Dehydrated hexane of 400 ml, triethyl aluminum of 0.8 mmol, diethyl aluminum chloride of 0.8 mmol and the titanium-containing catalyst ingredient, which was obtained in the above described (1), of 0.004 mmol as titanium atoms were put in an autoclave having the capacity of 1 l replaced with argon and heated to 90° C. In this time, a pressure within a system amounted to 1.5 kg/cm$^2$G. Then, hydrogen was supplied to increase the pressure to 5.5 kg/cm$^2$G and ethylene was continuously supplied so that the total pressure might be kept at 9.5 kg/cm$^2$G. The polymerization was carried out for one hour to obtain a polymer of 70 g. The polymerization activity was 365 kg/g.Ti/Hr and the MFR (the molten fluidity at 190° C. under load of 2.16 kg; JIS K 7210) of the obtained polymer was 40.

(3) Reaction of Titanium-containing Catalyst Ingredient with Fillers and Polymerization of Ethylene Hexane, which had been dehydrated at room temperature, of 500 ml and sintered ferrite powders F-200 (having a mean particle diameter of 70 μm manufactured by Powder Tech K.K.), which had been dried for 3 hours at 200 ° C. under vacuum (2 mmHg), of 450 g were put in an autoclave having the capacity of 1 l replaced with argon and the stirring was started. Then, the temperature was increased to 40° C. and 0.02 mmol as titanium atoms of the titanium-containing polymerization catalyst ingredient obtained according to (1) above mentioned was added and the resulting mixture was subjected to a reaction about 1 hour. Subsequently, triethyl aluminum of 2.0 mmol and diethyl aluminum chloride of 2.0 mmol were added and the resulting mixture was heated to 90° C. In this time, a pressure within a system amounted to 1.5 kg/cm$^2$G. Then, hydrogen was supplied to increase the pressure until 2 kg/cm$^2$G followed by conducting the polymerization for 40 minutes with continuously supplying ethylene so that the total pressure might be kept at 6 kg/cm$^2$G to obtain a ferrite-containing polyethylene composition of 473 g in all. The composition was dried for 1 hour at the room temperature under vacuum (2 mmHg) to obtain dried powders. The dried powders exhibited a uniform grayish white color and it was found by the electron microscopic observation that a surface of ferrite was thinly coated with polyethylene and no aggregation of ferrite particles among themselves was observed.

In this step, the obtained composition was measured by means of TGA (thermal balance) with the result that ferrite was contained in a quantity of 95.2 wt %.

Then, the composition was put in a hot gas current adjusted at 120° C. to be subjected to heat treatment for 2.0 hours. The obtained composition was classified by means of a sieve having $10^6$ μm sieve openings to remove particles of Ω μm or more.

PRODUCTION EXAMPLE 2 of Carrier

Ferrite of 450 g and the titanium-containing catalyst ingredient, which had been prepared in a manner similar to (1) of PRODUCTION EXAMPLE 1, of 0.02 mmol as titanium atoms were put in an autoclave having the capacity of 1 l replaced with argon and the resulting mixture was subjected to a reaction for one hour in the same manner as (3) of PRODUCTION EXAMPLE 1. Subsequently, carbon, black (Ketchen black DJ-600; manufactured by Lion Akuzo K.K.) of 0.47 g was added to the reaction mixture through an upper nozzle of the autoclave. Carbon black, which had been dried for one hour at 200° C. under vacuum and turned into a slurry by the use of dehydrated hexane, was used. Subsequently, triethyl aluminum of 2.0 mmol and diethyl aluminum chloride of 2.0 mmol were added to the reaction mixture and the resulting mixture was heated to 90° C. In this time, a pressure within a system amounted to 1.5 kg/cm$^2$G. Then hydrogen was supplied to increase the pressure until 2 kg/cm$^2$G followed by conducting the polymerization for 45 minutes with continuously supplying ethylene so that the total pressure might be kept at 6 kg/cm$^2$G to obtain a ferrite and carbon black-containing polyethylene composition of 469.3 g in all. The composition was dried for 1 hour at the room temperature under vacuum (2 mmHg) to obtain dried powders. The dried powders exhibited a uniform black color and it was observed by an electron microscope that a surface of ferrite was thinly coated with polyethylene and carbon black was uniformly dispersed in polyethylene. In addition, this composition was analyzed by TGA (thermal balance) with the results that ferrite was contained in a quantity of 95.9 wt % and a ratio by weight of ferrite, polyethylene and carbon black was 24:1:0.025 as calculated from charged quantities.

Then, the composition was put in a hot gas current adjusted at 120° C. to be subjected to heat treatment for 2.0 hours. The obtained composition was classified by means of a sieve having $10^6$ μm or more to remove aggregated particles.

PRODUCTION EXAMPLE 3 OF CARRIER

Ferrite of 450 g and the titanium-containing catalyst ingredient, which had been prepared according to (1) of PRODUCTION EXAMPLE 1, of 0.01 mmol as titanium atoms were put in an autoclave having the capacity of 1 l replaced with argon and the resulting mixture was subjected to a reaction for 1 hour in the same manner as in PRODUCTION EXAMPLE 1. Then, carbon black (Ketchen black EC manufactured by Lion Akuzo K.K.) of 0.50 g was put in the autoclave through an upper nozzle of the autoclave. In addition, carbon black, which had been dried for 1 hour at 200° C. under vacuum and turned into a slurry by the use of dehydrated hexane, was used. Subsequently, triethyl aluminum of 1.0 mmol and diethyl aluminum chloride of 1.0 mmol were added to the resulting slurry and the resulting mixture was heated to 90° C. In this time, a pressure within a system amounted to 1.5 kg/cm$^2$G. Then, 1-butene of 37.5 mmol (2.1 g) was introduced and hydrogen was supplied to increase the pressure until 2 kg/cm$^2$G followed by conducting the polymerization for 28 minutes with continuously supplying ethylene so that the total pressure might be kept at 6 kg/cm$^2$G to obtain a ferrite and carbon black-containing polyethylenic composition of 467 g in all. The composition was dried for 1 hour at the room temperature under vacuum (2 mmHg) to obtain dried powders. The dried powders exhibited a uniform black color and it was observed by means of an electron microscope that a surface of ferrite was thinly coated with the polymer and carbon black was uniformly dispersed in the polymer. In addition, this composition was measured by means of TGA (thermal balance) with the result that a ratio by weight of ferrite, polymer and carbon black was 27:1:0.03. Furthermore, the polymer, from which ferrite and carbon black had been removed, was obtained by the Soxhlet extraction (solvent: xylene) and subjected to the infrared absorption analysis with the confirmation that the obtained composition was a polyethylenic copolymer containing butene in a quantity of 8 wt %.

Then, the composition was put in a hot gas current adjusted at 120° C. to be subjected to heat treatment for 2.5 hours. The obtained composition was classified by means of a sieve having $10^6$ μm sieve openings to remove the particles of Ω μm or more.

PRODUCTION EXAMPLE 4 OF CARRIER

Polyethylene of low density (Hi-Wax 220P; made by Mitsui Sekiyu Kagaku K.K.) was dissolved in toluene and heated to prepare a 5% solution of polyethylene. Ferrite fine particles having mean particle size of 0.2 μm (250 parts by weight) were added into the 5% solution on the basis of 100 parts by weight of resin solids of the solution. The composition was stirred for uniform dispersion by means of ultrasonic Homogenizer to prepare a coating solution. The coating solution was applied repeatedly to sintered ferrite powders (core materials) (F-200:70 μm in mean particle size; made by Powder Tech K.K.) by SPIRA COTA; made by Okada Seiko K.K.) so that the resin layers of 10 percents by weight to the core materials might be formed on the core materials. The obtained carrier was dipped in a 6N HCl solution for 2 hours, washed well with water and then dried in a vacuum for 5 hours at 60° C. Thus, resin-coated carrier particles having pores on the surface thereof were obtained.

PRODUCTION EXAMPLE 5 OF CARRIER

A carrier was prepared in a manner similar to Production Example 4 except that the ferrite fine particles were not added and that the acid treatment was not carried out.

The carriers obtained in Production Examples 1–5 had filling ratio of core materials (wt %), true specific gravity (g/cm$^3$), bulk specific gravity (g/cm$^3$), electrical resistance(Ω.cm), specific surface area (m$^2$/g), total pore volume (ml/g) referred to as one gram of carrier, total pore volume (ml/ml) referred to as one milliliter of resin of coating layer and mean pore size as shown in Table 1.

TABLE 1

| carrier production Example No. | filling ratio of core material [wt %] | true specific gravity [g/cm$^3$] | bulk specific gravity [g/cm$^3$] | electrical resistance [Ω · cm] | specific surface area [m$^2$/g] | total pore volume [ml/g] | [ml/g] | mean pore size [μm] |
|---|---|---|---|---|---|---|---|---|
| 1 | 95.2 | 4.29 | 2.29 | $8.3 \times 10^{11}$ | 0.727 | 0.043 | 0.087 | 0.301 |
| 2 | 95.9 | 4.48 | 2.24 | $8.0 \times 10^{8}$ | 0.509 | 0.042 | 1.025 | 0.281 |
| 3 | 96.4 | 4.49 | 2.26 | $4.8 \times 10^{8}$ | 0.341 | 0.038 | 1.061 | 0.248 |
| 4 | 97.1 | 5.08 | 2.43 | $3.7 \times 10^{9}$ | 0.311 | 0.013 | 0.565 | 0.294 |
| 5 | 99.0 | 5.15 | 2.58 | $5.2 \times 10^{12}$ | 0.061 | 0.0005 | — | — |

The specific gravity was measured in the following procedures by the use of a measuring apparatus provided with an electronic balance:

the sensitivity is 0.1 mg; a pycnometer:

a specific-gravity bottle having an inside capacity of 50 ml provided with a Gay-Lussac thermometer provided in JIS R 3501 (glass wares for use in the analytical chemistry); and a constant temperature bath:

a water temperature can be kept at 23°±0.5° C.

1) A weight of a pycnometer, which has been previously dried, is accurately measured until a figure of 0.1 mg.

2) The pycnometer is filled with n-heptane, which has been sufficiently degased, and held in the constant temperature bath of 23°±0.5° C. followed by accurately setting a surface of a liquid to a gauge line. The pycnometer is taken out of the constant temperature bath and water stuck to an outside of the pycnometer is completely wiped off followed by accurately measuring a weight of the pycnometer with n-heptane therein until a figure of 0.1 mg.

3) Subsequently, the pycnometer is emptied and then filled with a sample of 10 to 15 g followed by accurately measuring a weight of the pycnometer with the sample therein again to subtract the result in 1) from the obtained result, whereby determining the weight of the sample.

4) Degased n-heptane of 20 to 30 ml is gently put in the pycnometer with the sample therein to completely cover the sample with n-heptane followed by gently removing air from the liquid in a vacuum desiccator.

5) Then, the pycnometer is filled with debased n-heptane until the vicinity of the gauge line and held in the constant temperature bath of 23°±0.5° C. for 1 hour. After the surface of the liquid was accurately set to the gauge line, the pycnometer is taken out of the constant temperature bath and water stuck to the outside of the pycnometer is completely wiped off followed by accurately measuring a weight of the pycnometer with the sample and n-heptane therein until a figure of 0.1 mg.

6) The specific gravity is calculated by the following equation:

$$S=a\cdot d/(b-c+a)$$

wherein S: specific gravity;

a: weight of the sample (g);

b: weight (g) of the pycnometer with an immersion liquid filled until the gauge line thereof;

c: weight (g) of the pycnometer containing the sample with the immersion liquid filled until the gauge line thereof; and d: specific gravity of the immersion liquid at 23° C.

Bulk specific gravity was measured according to JIS Z 2504.

The electric resistance was calculated in inherent bulk resistance $\rho$ by placing the sample having a thickness of 1 mm and a diameter of 50 mm on a metallic circular electrode, placing an electrode having a weight of 895.4 g and a diameter of 20 mm and a gird electrode having an inside diameter of 38 mm and an outside diameter of 42 mm on the sample, and reading a value of an electric current after 1 minute from a point of time when the application of a direct current voltage of 500 V was started. The measurements were repeated 5 times under the environment that a temperature was 25°±1° C. and a relative humidity was 55±5% and their mean value was adopted.

The specific surface area was measured by means of BET method on the basis of nitrogen gas absorption, using Flow Sorb 2300 (made by Shimazu Seisakusho K.K.).

The total pore volume and the mean pore size were calculated from distribution of carrier pores. The distribution of carrier pores was measured by mercury porosimetry, using Pore Sizer 9310 (made by Shimazu Seisakusho K.K.) under conditions of 130° in mercury contact angle and 484 dyn/cm in surface tension. The results were shown in FIG. 4–FIG. 8.

Figure 4:
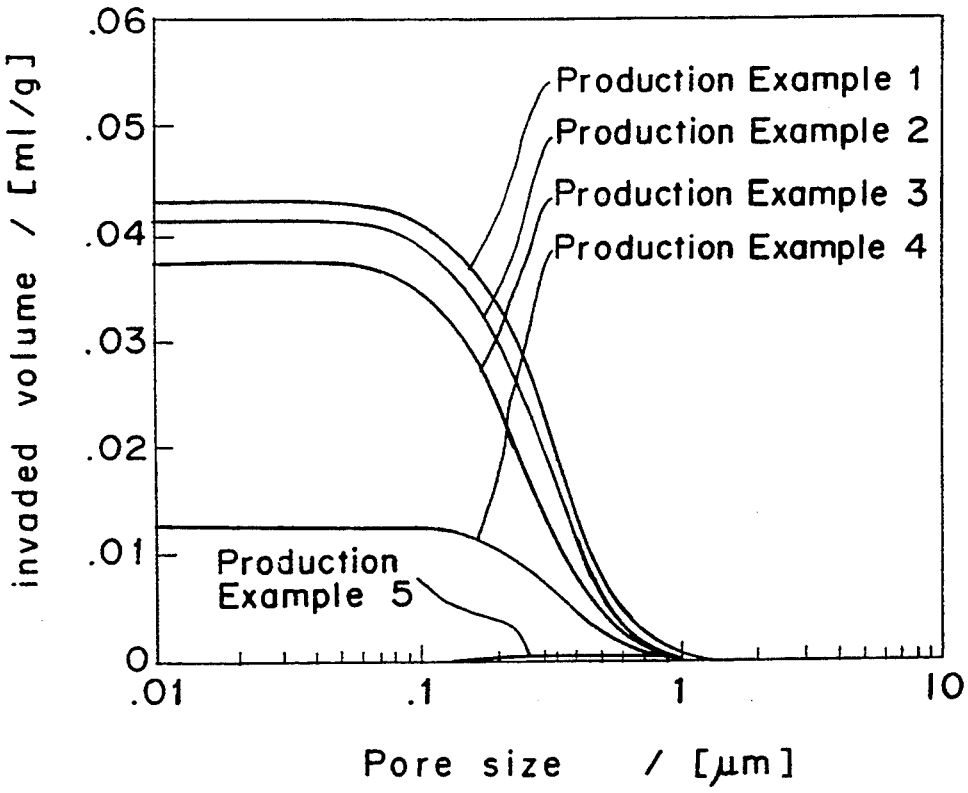
FIG. 4 shows a relationship between pore size and invaded volume.
Figure 5:
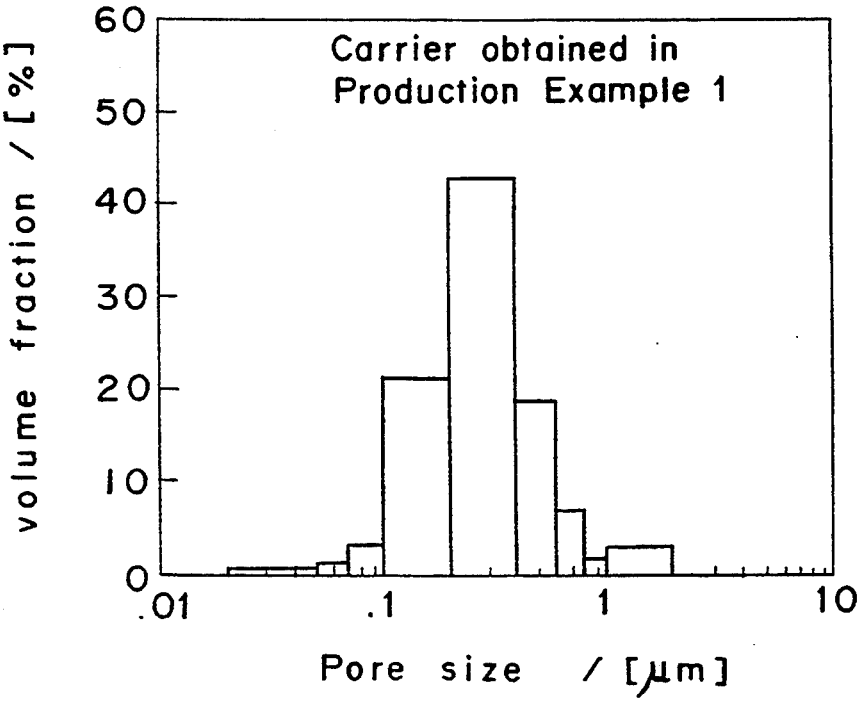
FIG. 5–FIG. 8 show a relationship between pore size and volume fraction.
Figure 6:
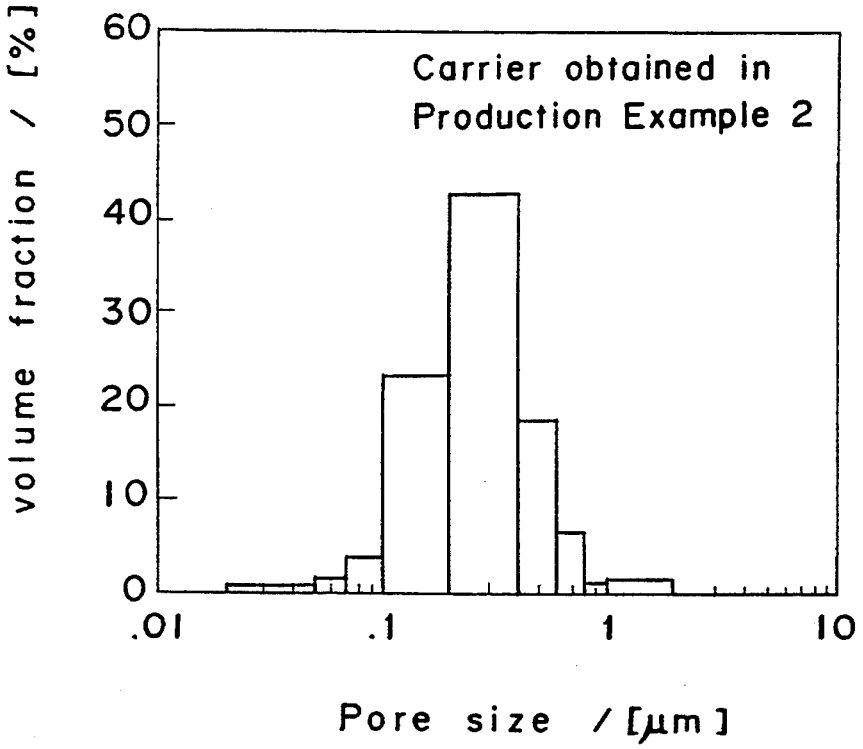
Figure 7:
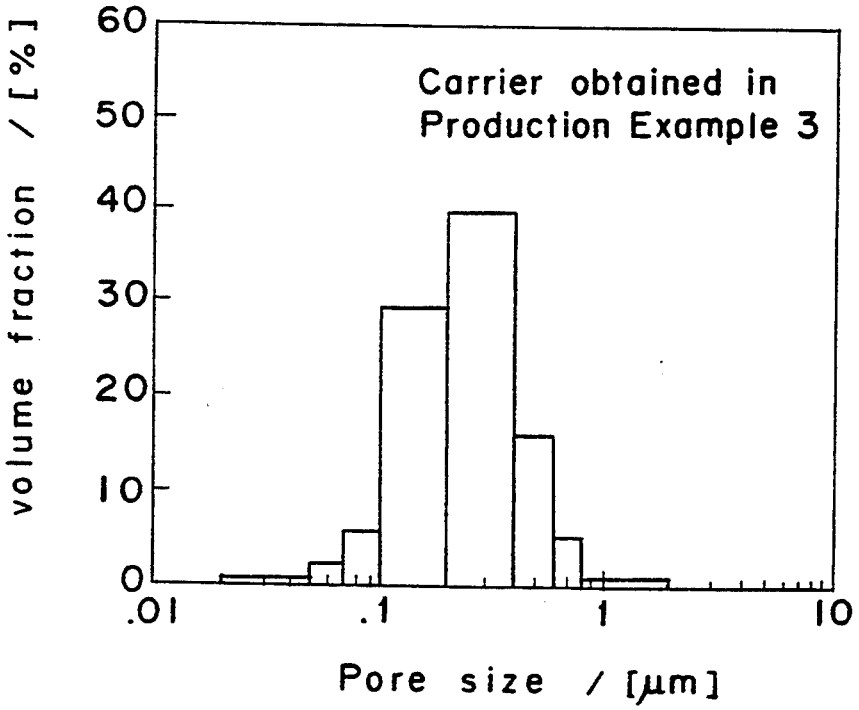
Figure 8:
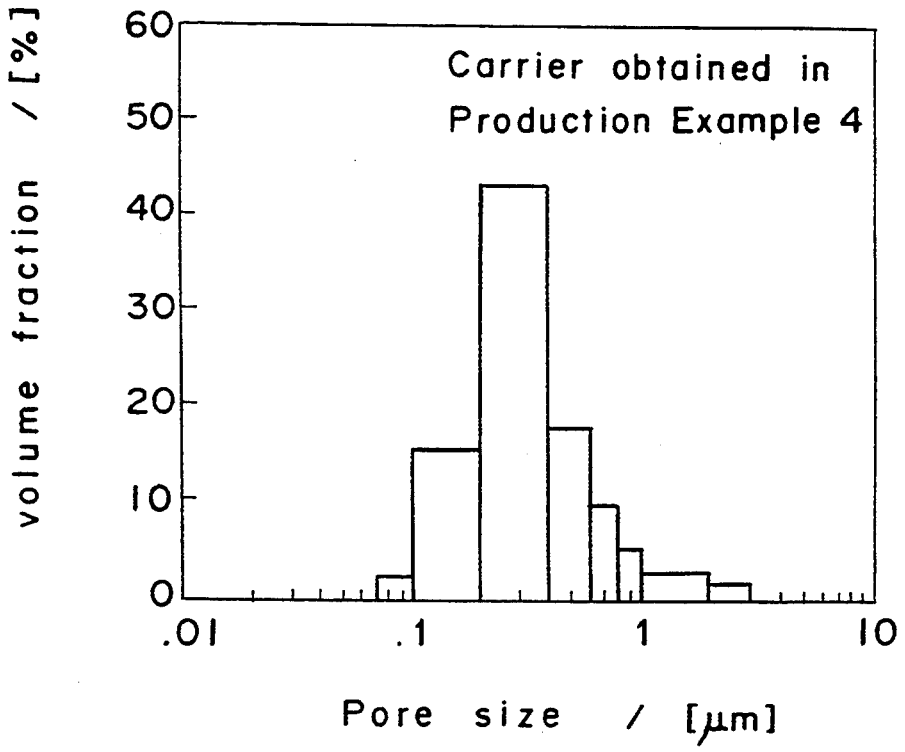

FIG. 4 shows the relationship between pore size and invaded volume. The invaded volume means the volume of mercury pressed into pores up to maximal pressure.

FIG. 5–FIG. 8 show the relationship between pore size and volume fraction. The volume fraction means the ratio (%) of the total volume of pores within the range of specified pore size to the total volume of all pores.

Production Example 1 of Toner

An aqueous solution of 62 g containing benzyltributylammonium chloride at 50% content was diluted with 80 ml of water. A solution containing sodium 4-amino-1-naphthalenesulfonate of 24.5 g in 500 ml of water was dropped into the above obtained aqueous solution at room temperature while stirring. The temperature was increased up to 80° C. and the reaction was carried out for 1 hour. The reaction solution was cooled to about 30° C. while stirring. The deposited materials were filtered, washed and dried. Thus, white powder (44 g) of benzyltributylammonium-4-amino-1-naphthalenesulfonate having a melting point of 128°–133° C. was obtained.

| | parts by weight |
|---|---|
| styrene-acrylic copolymer (mean molecular weight ($\overline{M}n$):3000, molecular weight distribution ($\overline{M}w/\overline{M}n$):60 softening point: 120° C., glass transition point: 60° C.) | 100 |
| carbon black MA#8 (made by Mitsubishi Kasei K.K.) | 8 |
| polypropylene of low molecular weight (Biscol 660P; made by Sanyo Kasei Kogyo K.K.) | 5 |
| benzyltributylammonium-4-amino-1-naphthalenesulfonate above mentioned | 5 |

The ingredients described above were mixed well in a Henschel mixer and kneaded using an extrusion kneader PCM-30 (made by Ikegai Tekkosho K.K.). The kneaded mixture was cooled and coarsely pulverized in a feather mill. Then, the obtained particles were further pulverized into fine particles under jet stream. Then, the obtained fine particles were air-classified to obtain a positively chargeable toner having a mean particle size of 8 μm. The toner obtained in this example was referred to as. Toner A.

Production Example 2 of Toner

Cetylpyridinium chloride of 40.80 g was dissolved in water of 367 ml. The obtained solution was mixed with a solution of sodium dodecylbenzenesulfonate of 46.9 g dissolved in water of 422 ml to prepare cetylpyridinium-dodecylbenzenesulfonate.

| | parts by weight |
|---|---|
| styrene-acrylic copolymer (mean molecular weight ($\overline{M}n$):5600, molecular weight distribution ($\overline{M}w/\overline{M}n$):38 softening point: 133° C., glass transition point: 61° C.) | 100 |
| carbon black MA#8 (made by Mitsubishi Kasei K.K.) | 8 |
| polypropylene of low molecular weight (Biscol 660P; made by Sanyo Kasei Kogyo K.K.) | 5 |
| cetylpyridinium · dodecylbenzenesulfonate above obtained | 3 |

The ingredients described above were mixed well in a Henschel mixer and kneaded using an extrusion kneader PCM-30 (made by Ikegai Tekkosho K.K.). The kneaded mixture was cooled and coarsely pulverized in a feather mill. Then, the obtained particles were further pulverized into fine particles under jet stream. Then, the obtained fine particles were air-classified to obtain a positively chargeable toner having a mean particle size of 8.3 μm. The toner obtained in this example was referred to as Toner B.

Production Example 3 of Toner

Dimethylaminopropylene of 145 g (1.42 g mole), triethylamine of 3.92 g (0.039 mole) and xylene of 1 liter were put into a three-necked round flask of 2-liter capacity equipped with a stirrer, a thermometer, a heat mantle, a Dean-Stark trap and a reflux condenser. Then, phthalic anhydride of 191.3 g (1.29 mol) was added into the flask and the mixture was refluxed at 140° C. After 24 hours, 24 ml of water was trapped in the Dean-Stark trap.

Then, exylene and excessive amine were removed from the reaction mixture by a rotary evaporator. Crude products of 300 g of N-(dimethylaminopropyl)phthalimide were obtained. This separated crude imide was brown and syrupy. This imide product was purified by vacuum evaporation and identified by elemental analysis and infrared spectrophotometric analysis. The obtained imide of 300 g was dissolved in acetone of 1.5 liter in a three-necked round flask of 5-liter capacity equipped witch a stirrer, a thermometer and a dropping funnel.

The flask was set in an ice bath to cool the contents to 10° C. A solution of dimethylsulfate of 200 g (1.58 mole) dissolved in 500 ml of acetone was dropped into the flask. White materials were precipitated at once. The mixture was stirred for 2 hours. Then, the products were filtered, washed with acetone and dried. Thus, (3-phthalimidopropyl)tri-methylammonium methylsulfate of 472.9 g was obtained (yield: 97.8%)

| | parts by weight |
|---|---|
| styrene-acrylic copolymer (mean molecular weight ($\overline{Mn}$):5600, molecular weight distribution (Mw/Mn):38 softening point: 133° C., glass transition point: 61° C.) | 100 |
| carbon black MA#8 (made by Mitsubishi Kasei K.K.) | 8 |
| polypropylene of low molecular weight (Biscol 660P; made by Sanyo Kasei Kogyo K.K.) | 5 |
| (3-phthalimidopropyl)trimethylammonium methylsulfate obtained above | 3 |

The ingredients described above were mixed well in a Henschel mixer and kneaded using an extrusion kneader PCM-30 (made by Ikegai Tekkosho K.K.). The kneaded mixture was cooled and coarsely pulverized in a feather mill. Then, the obtained particles were further pulverized into fine particles under jet stream. Then, the obtained fine particles were air-classified to obtain a positively chargeable toner having a mean particle size of 8 μm. The toner obtained in this example was referred to as Toner C.

Production Example 4 of Toner

| | parts by weight |
|---|---|
| styrene-acrylic copolymer (mean molecular weight ($\overline{Mn}$):5600, molecular weight distribution (Mw/Mn):38 softening point: 133° C., glass transition point: 61° C.) | 100 |
| carbon black MA#8 (made by Mitsubishi Kasei K.K.) | 8 |
| polypropylene of low molecular weight (Biscol 660P; made by Sanyo Kasei Kogyo K.K.) | 5 |
| styrene-2-vinylpyridine copolymer (monomer weight ratio 90:10) | 15 |

The ingredients described above were mixed well in a Henschel mixer and kneaded using an extrusion kneader PCM-30 (made by Ikegai Tekkosho K.K.). The kneaded mixture was cooled and coarsely pulverized in a feather mill. Then, the obtained particles were further pulverized into fine particles under jet stream. Then, the obtained fine particles were air-classified to obtain a positively chargeable toner having a mean particle size of 8.3 μm. The toner obtained in this example was referred to as Toner D.

Production Example 5 of toner

| | parts by weight |
|---|---|
| styrene-acrylic copolymer (mean molecular weight ($\overline{Mn}$):5600, molecular weight distribution (Mw/Mn):38 softening point: 133° C., glass transition point: 61° C.) | 100 |
| carbon black MA#8 (made by Mitsubishi Kasei K.K.) | 8 |
| polypropylene of low molecular weight | 5 |
| styrene-diethylaminoethyl methacrylate copolymer (monomer weight ratio 90:10) | 10 |
| benzyltributylammonium-4-amino-1-naphthalenesulfonate | 3 |

The ingredients described above were mixed well in a Henschel mixer and kneaded using an extrusion kneader PCM-30 (made by Ikegai Tekkosho K.K.). The kneaded mixture was cooled and coarsely pulverized in a feather mill. Then, the obtained particles were further pulverized into fine particles under jet stream. Then, the obtained fine particles were air-classified to obtain a positively chargeable toner having a mean particle size of 9 μm. The toner obtained in this example was referred to as Toner E.

Production Example 6 of Toner

| | parts by weight |
|---|---|
| styrene-acrylic copolymer (mean molecular weight ($\overline{Mn}$):4000, molecular weight distribution (Mw/Mn):40 softening point: 125° C., glass transition point: 58° C.) | 100 |
| carbon black MA#8 (made by Mitsubishi Kasei K.K.) | 8 |
| polypropylene of low molecular weight (Viscol 660; made by Sanyo Kasei Kogyo K.K.) | 5 |
| nigrosine base Bontron N-01 (made by Oriento Kagaku Kogyo K.K.) | 5 |

The ingredients described above were mixed well in a Henschel mixer and kneaded using an extrusion kneader PCM-30 (made by Ikegai Tekkosho K.K.). The kneaded mixture was cooled and coarsely pulverized in a feather mill. Then, the obtained particles were further pulverized into fine particles under jet stream. Then, the obtained fine particles were air-classified to obtain a positively chargeable toner having a mean particle size of 8 μm. The toner obtained in this example was referred to as Toner F.

Production Example 7 of Toner

A positively chargeable toner having a mean particle size of 8 μm was prepared in a manner similar to Production Example 6 of Toner except that Bontron N-01 of 1 parts by weight was used. The toner obtained in this example was referred to as Toner G.

Evaluation of Developer (toner charging speed, toner scattering properties and charging amount)

A developer was prepared using carriers and toners obtained above. The developer was evaluated on toner charging speed $\tau$ (sec) and toner scattering properties. The results were shown in Table 2.

The toner charging speed was measured according to the method described in Kenichi Karakida, Journal of Electrophotography (academic society of electrophotography) 402,27 (1988), by the use of a developer containing Toners A–E at the content of 2 wt %.

The toner scattering properties were measured as follows;

A developer was prepared in the combination of the toner and the carrier as shown in Table 2 so that the toner content (wt %) might be obtained as shown in Table 2. The developer of 450 ml was put into a developing machine (EP-8600; made by Minolta Camera K.K.). Then a motor was connected to a driving system of the developing machine and driven for 1 hour so that the circumferential speed of sleeve might be 60 cm/sec. Then, the scattering toner adhered to an opening portion of the sleeve in the developing machine was sucked. The sucked toner was weight and ranked as follows;

⊙: <10 mg

∘: 10–30 mg

Δ: 30–80 mg x: >80 mg

The charging amount was measured as follows:

A developer was prepared and put into the developing machine in a manner similar to that described in the toner scattering properties. Charging amounts were measured after the developing machine was driven for 1 hour and 100 hours.

TABLE 2

| | Toner | Production Example of Carrier | charging speed [sec] (mixing ratio of toner (wt %)) | toner scattering properties (mixing ratio of toner (wt %)) | charging amount [μc/g] after stirred for 1 hour | charging amount [μc/g] after stirred for 100 hours |
|---|---|---|---|---|---|---|
| Example 1 | A | 1 | 6.8 (2 wt %) | ⊙ (6 wt %) | 9.6 | 10.3 |
| Example 2 | B | 2 | 7.3 (2 wt %) | ⊙ (6 wt %) | 12.2 | 11.7 |
| Example 3 | C | 3 | 7.1 (2 wt %) | ⊙ (6 wt %) | 10.1 | 9.8 |
| Example 4 | D | 4 | 6.9 (2 wt %) | ⊙ (6 wt %) | 13.6 | 14.0 |
| Example 5 | E | 5 | 10.1 (2 wt %) | ∘ (6 wt %) | 8.7 | 9.1 |
| Com. Ex. 1 | F | 5 | 18.2 (2 wt %) | ∘ (6 wt %) | 11.9 | 42.5 |
| Com. Ex. 2 | G | 5 | 17.7 (2 wt %) | Δ (6 wt %) | 18.6 | 38.7 |

What is claimed is:

1. A developer for electrophotography composed of positive chargeable toner particles comprising a thermoplastic resin, a colorant, and a positive charge controlling agent selected from the group consisting of quaternary ammonium compounds; and nitrogen-containing polymers, the toner particles having a mean particle size of 3–20 μm, and carrier particles comprising a core material formed of magnetic materials and a polyolefinic resin-coating layer coating the core materials, the carrier particles having a mean particle size of 20–100 μm, a coating ratio of the polyolefinic resin of 70% or more, a filling ratio of the core material of 90% or more and an electrical resistance of $1\times10^{6}-1\times10^{14}$ Ω.cm wherein the quaternary compounds are selected from the group consisting of ammonium compounds represented by the formulae I–VI:

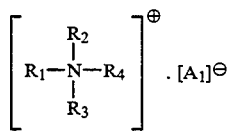

(I)

in which $R_1$, $R_2$, $R_3$ and $R_4$ represent respectively a hydrogen atom, a $C_1$–$C_{30}$ alkyl group, an aralkyl group or an aryl group and $A_1$ represents a sulfate ion, a nitrate ion, a borate ion, a basic ion, a chlorine ion, an iodine ion, a molybdate ion, a tungstate ion, or ion of heteropolyacid;

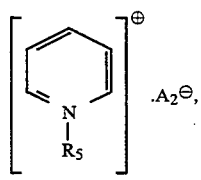

(II)

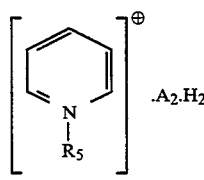

(III)

-continued

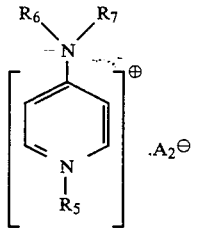

(IV)

in which $R_5$ is a $C_1$–$C_{20}$ alkyl group, $R_6$ and $R_7$ are a $C_1$–$C_{20}$ alkyl group respectively, $R_6$ and $R_7$ may form a ring in combination and $A_2$ is a halogen anion, a sulfate ion, a sulfite ion or a borate ion;

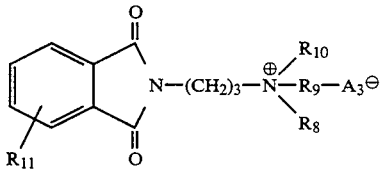

(V)

in which $R_8$, $R_9$ and $R_{10}$ are a $C_1$–$C_{25}$ alkyl group respectively, $R_{11}$ is a hydrogen atom, a nitro group, a halogen atom, an amino group or an alkyl group, $A_3$ is a halogen anion, a sulfate ion, a toluenesulfonyl ion, a sulfonate ion or a tetrafluoroborate ion; and

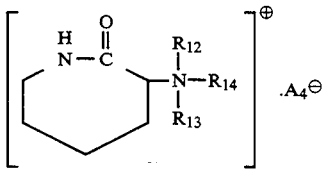

(VI)

in which $R_{12}$, $R_{13}$ and $R_{14}$ are a hydrogen atom, an alkyl group, an aryl group, an aralkyl group, or a cycloalkyl group respectively and $A_4$ is a halogen anion or a sulfate ion; and the nitrogen containing polymers are selected from the group of polymers represented by the formulae VII–XII:

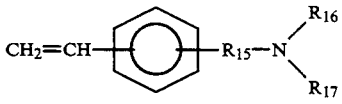

(VII)

in which $R_{15}$ is a $C_0$–$C_{12}$ alkylene group and $R_{16}$ and $R_{17}$ are a hydrogen atom or a $C_1$–$C_{20}$ alkyl group, respectively;

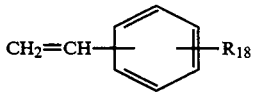

(VIII)

in which $R_{18}$ is a hydrogen atom or a lower alkyl group;

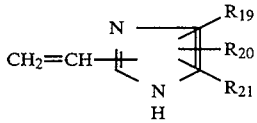

(IX)

in which $R_{19}$, $R_{20}$ and $R_{21}$ are respectively a hydrogen atom or a $C_1$–$C_{20}$ alkyl group;

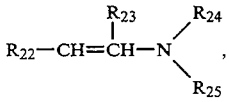

(X)

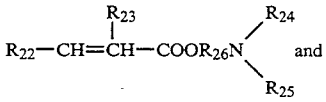

(XI)

and

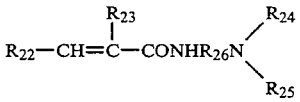

(XII)

in which $R_{22}$ and $R_{23}$ are respectively a hydrogen atom or a $C_1$–$C_{10}$ alkyl group, $R_{24}$ and $R_{25}$ are respectively a hydrogen atom, a $C_1$–$C_{20}$ alkyl group or an aryl group and $R_{26}$ is a $C_1$–$C_{20}$ alkylene group.

2. A developer of claim 1, in which the positive charge controlling agent is contained at the content of 0.1–20 parts by weight on the basis of 100 parts by weight of the thermoplastic resin.

3. A developer of claim 1, in which the positive chargeable toner particles further contain a polyolefinic wax of low molecular weight.

4. A developer of claim 1, in which the polyolefinic resin layer contains fine particles having charge controlling function.

5. A developer of claim 4, in which the fine particles having charge controlling function are contained at a content of 0.1–60 wt % to the polyolefinic resin layer.

6. A developer of claim 1, in which the polyolefinic resin layer contains electrically conductive fine particles.

7. A developer of claim 6, in which the electrically conductive fine particles are contained at a content of 0.1–60 wt % to the polyolefinic resin layer.

8. A developer of claim 1, in which the carrier particles have a true specific gravity of 3.5–7.5.

9. A developer of claim 1, in which the polyolefinic resin coating layer is prepared by pre-treating the core material with a catalyst and polymerizing an olefinic monomer on the surface of the core material.

10. A developer for electrophotography composed of positive chargeable toner particles comprising a thermoplastic resin, a colorant, and a positive charge controlling agent selected from the group consisting of quaternary ammonium compounds; and nitrogen-containing polymers, the toner particles having a mean particle size of 3–20 μm, and carrier particles comprising a core material formed of magnetic materials and a polyolefinic resin-coating layer coating the core materials and having pores which have pore size distributed within the range of 0.001–3 μm and mean particle size within the range of 0.1–0.5 μm wherein the quaternary compounds are selected from the group consisting of ammonium compounds represented by the formulae I–VI:

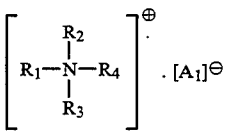

(I)

in which $R_1$, $R_2$, $R_3$ and $R_4$ represent respectively a hydrogen atom, a $C_1$–$C_{30}$ alkyl group, an aralkyl group or an aryl group and $A_1$ represents a sulfate ion, a nitrate ion, a borate ion, a basic ion, a chlorine ion, an iodine ion, a molybdate ion, a tungstate ion, or ion of heteropolyacid;

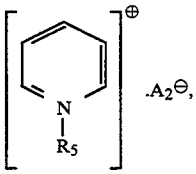

(II)

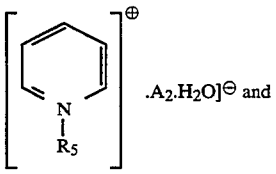

(III)

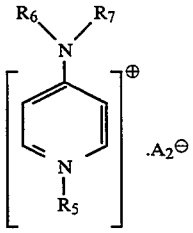

(IV)

in which $R_5$ is a $C_1$–$C_{20}$ alkyl group, $R_6$ and $R_7$ are a $C_1$–$C_{20}$ alkyl group respectively, $R_6$ and $R_7$ may form a ring in combination and $A_2$ is a halogen anion, a sulfate ion, a sulfite ion or a borate ion;

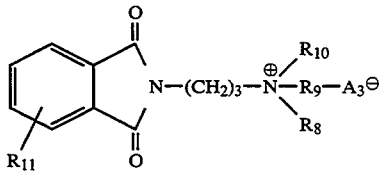

(V)

in which $R_8$, $R_9$ and $R_{10}$ are a $C_1$–$C_{25}$ alkyl group respectively, $R_{11}$ is a hydrogen atom, a nitro group, a halogen atom, an amino group or an alkyl group, $A_3$ is a halogen anion, a sulfate ion, a toluenesulfonyl ion, a sulfonate ion or a tetrafluoroborate ion; and

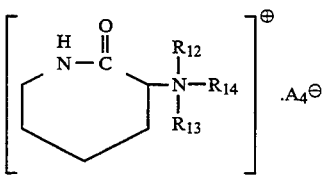

(VI)

in which $R_{12}$, $R_{13}$ and $R_{14}$ are a hydrogen atom, an alkyl group, an aryl group, an aralkyl group, or a cycloalkyl group respectively and $A_4$ is a halogen anion or a sulfate ion; and the nitrogen containing polymers are selected from the group of polymers represented by the formulae VII–XII:

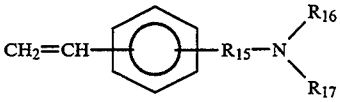

(VII)

in which $R_{15}$ is a $C_0$–$C_{12}$ alkylene group and $R_{16}$ and $R_{17}$ are a hydrogen atom or a $C_1$–$C_{20}$ alkyl group, respectively;

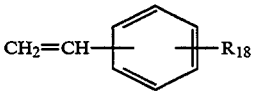

(VIII)

in which $R_{18}$ is a hydrogen atom or a lower alkyl group;

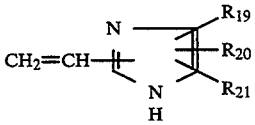

(IX)

in which $R_{19}$, $R_{20}$ and $R_{21}$ are respectively a hydrogen atom or a $C_1$–$C_{20}$ alkyl group;

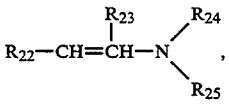

(X)

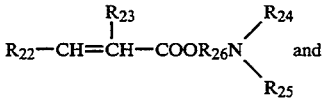

(XI)

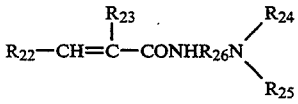

(XII)

in which $R_{22}$ and $R_{23}$ are respectively a hydrogen atom or a $C_1$–$C_{10}$ alkyl group, $R_{24}$ and $R_{25}$ are respectively a hydrogen atom, a $C_1$–$C_{20}$ alkyl group or an aryl group and $R_{26}$ is a $C_1$–$C_{20}$ alkylene group.

11. A developer of claim 10, in which the pore volume per one gram of the carrier particles is 0.001–0.1 ml/g.

12. A developer of claim 10, in which the pore volume per one milliliter of the coating layer is 0.1–2 ml/ml.

13. A developer of claim 10, in which the polyolefinic resin coating layer is prepared by pre-treating the core material with a catalyst and polymerizing an olefinic monomer on the surface of the core material.

14. A developer of claim 10, in which the polyolefinic resin coating layer is prepared by forming polyolefinic resin layers containing fine particles which are soluble in a solvent and have a mean particle size of 0.1–0.5 μm dispersed in the polyolefinic resin, and then eluting the fine particles with the solvent which can dissolve the fine particles.

15. A developer for electrophotography composed of positive chargeable toner particles comprising a thermoplastic resin, a colorant, and a positive charge controlling agent selected from the group consisting of quaternary ammonium compounds and nitrogen-containing polymers, the toner particles having a mean particle size of 3–20 μm, and carrier particles comprising a core material formed of magnetic materials and a polyolefinic resin-coating layer coating the core materials, the polyolefinic resin coating layer being prepared by pre-treating the core material with a catalyst and polymerizing a olefinic monomer on the surface of the core material wherein the quaternary compounds are selected from the group consisting of ammonium compounds represented by the formulae I–VI:

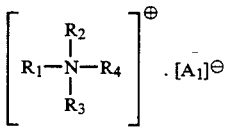

(I)

in which $R_1$, $R_2$, $R_3$ and $R_4$ represent respectively a hydrogen atom, a $C_1$–$C_{30}$ alkyl group, an aralkyl group or an aryl group and $A_1$ represents a sulfate ion, a nitrate ion, a borate ion, a basic ion, a chlorine ion, an iodine ion, a molybdate ion, a tungstate ion, or ion of heteropolyacid;

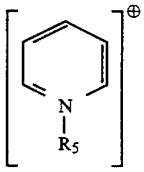

(II)

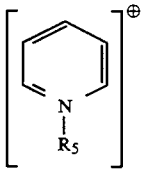

(III)

-continued

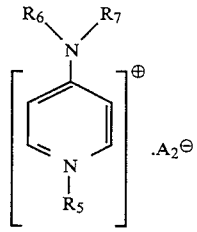

(IV)

in which $R_5$ is a $C_1$–$C_{20}$ alkyl group, $R_6$ and $R_7$ are a $C_1$–$C_{20}$ alkyl group respectively, $R_6$ and $R_7$ may form a ring in combination and $A_2$ is a halogen anion, a sulfate ion, a sulfite ion or a borate ion;

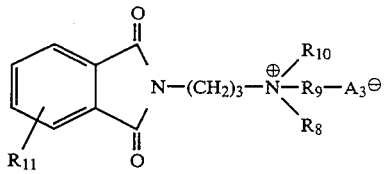

(V)

in which $R_8$, $R_9$ and $R_{10}$ are a $C_1$–$C_{25}$ alkyl group respectively, $R_{11}$ is a hydrogen atom, a nitro group, a halogen atom, an amino group or an alkyl group, $A_3$ is a halogen anion, a sulfate ion, a toluenesulfonyl ion, a sulfonate ion or a tetrafluoroborate ion; and

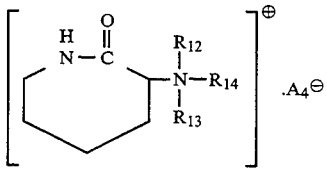

(VI)

in which $R_{12}$, $R_{13}$ and $R_{14}$ are a hydrogen atom, an alkyl group, an aryl group, an aralkyl group, or a cycloalkyl group respectively and $A_4$ is a halogen anion or a sulfate ion; and the nitrogen containing polymers are selected from the group of polymers represented by the formulae VII–XII:

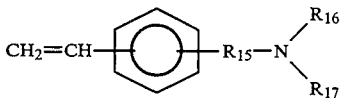

(VII)

in which $R_{15}$ is a $C_0$–$C_{12}$ alkylene group and $R_{16}$ and $R_{17}$ are a hydrogen atom or a $C_1$–$C_{20}$ alkyl group, respectively;

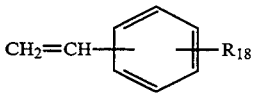

(VIII)

in which $R_{18}$ is a hydrogen atom or a lower alkyl group;

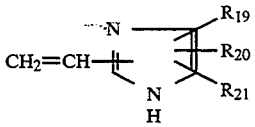

(IX)

in which $R_{19}$, $R_{20}$ and $R_{21}$ are respectively a hydrogen atom or a $C_1$–$C_{20}$ alkyl group;

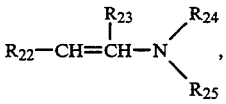

(X)

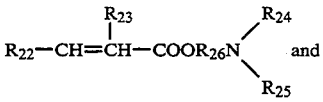

(XI)

-continued

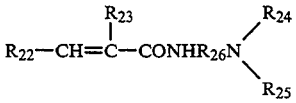

(XII)

in which $R_{22}$ and $R_{23}$ are respectively a hydrogen atom or a $C_1$–$C_{10}$ alkyl group, $R_{24}$ and $R_{25}$ are respectively a hydrogen atom, a $C_1$–$C_{20}$ alkyl group or an aryl group and $R_{26}$ is a $C_1$–$C_{20}$ alkylene group.

16. A developer of claim 15, in which the polyolefinic resin coating layer has protuberances formed by polymerizing an olefinic monomer.

17. A developer of claim 16, in which the protuberances are grown from the catalyst component.

18. A developer of claim 15, in which the carrier particles have a shape factor S of 130–200, the shape factor S being represented by the following formula;

$$S=\{(\text{outside circumference})^2/\text{area}\}\times\{1/(4\pi)\}\times 100$$

wherein the "outside circumference" is a mean value of outside circumferences of projected images of the carrier particles and the "area" is a mean value of projected areas of the carrier particles.

* * * * *